United States Patent [19]

Verhoeven et al.

[11] Patent Number: 4,826,445

[45] Date of Patent: May 2, 1989

[54] CARD READER HOLDER

[75] Inventors: Laurentius M. Verhoeven, Veghel; Cornelis G. J. Van Nes, Oisterwijk, both of Netherlands

[73] Assignee: E. I. Du Pont de Nemours and Company, Wilmington, Del.

[21] Appl. No.: 246,881

[22] Filed: Sep. 13, 1988

Related U.S. Application Data

[63] Continuation of Ser. No. 173,019, Mar. 25, 1988, abandoned, which is a continuation of Ser. No. 35,932, Apr. 8, 1987, abandoned, which is a continuation of Ser. No. 830,841, Feb. 19, 1986, Pat. No. 4,696,529.

[30] Foreign Application Priority Data

Mar. 1, 1985 [NL] Netherlands ..... 8500587

[51] Int. Cl.[4] ..... H01R 13/26

[52] U.S. Cl. ..... 439/267; 439/637

[58] Field of Search ..... 439/59–62, 439/260, 267, 325–328, 629–637

[56] References Cited

U.S. PATENT DOCUMENTS

| | | | |
|---|---|---|---|
| 3,075,167 | 1/1963 | Kinkaid | 339/176 |
| 3,567,998 | 3/1971 | Ammerman | 317/101 |
| 3,611,259 | 10/1971 | Palecek | 339/74 |
| 3,720,907 | 3/1973 | Asick | 339/176 |
| 3,930,706 | 1/1976 | Obuch et al. | 339/64 |
| 3,937,403 | 2/1976 | Lawson | 339/97 |
| 3,980,376 | 9/1976 | Rosen | 339/75 |
| 3,980,377 | 9/1976 | Oxley | 339/75 |
| 4,118,094 | 10/1978 | Key | 339/75 |
| 4,221,448 | 9/1980 | Logerot et al. | 339/75 |
| 4,275,944 | 6/1981 | Sochor | 339/74 |
| 4,443,049 | 4/1984 | De Pommery et al. | 339/75 |
| 4,449,775 | 5/1984 | De Pommery et al. | 339/75 |

FOREIGN PATENT DOCUMENTS

| | | | |
|---|---|---|---|
| 1465687 | 5/1969 | Fed. Rep. of Germany . | |
| 1391864 | 2/1965 | France . | |
| 2185914 | 1/1974 | France . | |
| 22981 | 9/1969 | Japan | 339/176 MP |
| 977982 | 12/1964 | United Kingdom . | |

*Primary Examiner*—Joseph H. McGlynn

[57] ABSTRACT

A holder for receiving cards with electronically stored data or printed circuit boards. The holder has guide means to receive the card. The holder is provided with a connector with contact springs for contacting connection strips located on the card. One end of each contact spring is clamped while the other is free to move and make contact with the connection strips. The contact springs include the parts formed by bending and shaped so as to minimize pressure and friction against the connection strips of the card.

1 Claim, 5 Drawing Sheets

CARD READER HOLDER

This application is a continuation of application Ser. No. 173,019 filed Mar. 25, 1988, now abandoned which is a continuation of application Ser. No. 035,932 filed Apr. 8, 1987, now abandoned, which is a continuation of application Ser. No. 830,841 filed Feb. 19, 1986, now U.S. Pat. No. 4,696,529.

BACKGROUND OF THE INVENTION

The invention relates to credit and other cards with electronically stored data which can be read and printed circuit boards, and more particular to a holder provided with guide means to receive such cards.

Automation in banking has led to electronic data processing of many banking functions. Automatic bank teller machines are now a common sight. Various banking transactions, including customer withdrawal, can be done at these machines by means of precoded cards such as credit cards.

There is now the possibility of providing on such a card a memory chip by means of which personal data can be stored. This data can be read when the card is inserted into a guide groove of a holder intended for the purpose and when connection strips on the card contact contact springs disposed in the holder. The connection strips are preferably in the form of edge contacts.

It is extremely important that the card should be usable many times without the edge contacts being damaged by the contact springs. Such damage occurs in existing cards because a certain contact pressure is necessary for reliable reading of the card. Consequently, friction occurring between the contact springs and connection strips, results in unacceptable wear.

SUMMARY OF THE INVENTION

The object of the invention is to provide a holder of the type described above which avoid the above problem.

This object is achieved according to the invention in that each contact spring has a first spring end part which is adjacent to the movable end of the contact spring, an intermediate spring part and a second clamped spring end part serving as connection terminal; said first contact spring part being disposed substantially perpendicular to the intermediate spring part, and said intermediate part being substantially perpendicular to the infeed plane of the holder; that the first spring part is spaced from the shifting plane of the connection strips; and that a stop element is located at the point where the first spring end part and the intermediate spring part join, said stop element extending from the plane of the first spring end part into the infeed plane of the holder. One of the advantages achieved by this arrangement is that during the build-up of the contact pressure, the contact point between contact spring and connection strip undergoes no relative displacement.

The contact spring parts and their respective stop elements are preferably bent from one piece. In an embodiment in which the contact spring is in one piece, the intermediate spring part continues past the first spring end part and, after successively bending back through 180 degrees and bending through 90 degrees, the intermediate spring part merges into the first.

In another embodiment the stop element is formed by at least one extension piece of the intermediate spring part continuing along the first spring end part.

An embodiment which is particularly suitable for adjustment the contact spring is characterized in that the extension piece is bent in the direction of the first spring part along a bending line which runs substantially parallel to the center line of the intermediate spring part. Adjustment of the contact pressure takes place by setting the width of the extension piece or the angle thereof relative to the intermediate spring part.

According to another embodiment of the invention, the end of the first spring part is bent back through less than 180 degrees and can make contact with a connection strip of an inserted card.

According to yet another embodiment, the intermediate spring part, after successively bending back through 180 degrees and bending through 90 degrees, merges into the second spring end part which is parallel to the first spring part.

Since a card reader provided with the card holder is usually fitted on the outside of an apparatus, the contact springs cannot be soldered in customary fashion into a plate with printed wiring. An embodiment which solves this problem is characterized in that the second contact spring part is provided at the clamped end with forced-out points. When these points have been pushed through a ribbon cable, they are bent back against the ribbon cable. This procudes a reliable contact between contact spring and a conductor of the ribbon cable.

The abovementioned object to provide a holder which avoids the friction between the contact springs and connection strips is achieved according to a second aspect of the invention in that each contact spring has a first spring end part which is adjacent to the movable end of the contact spring, an intermediate spring part bent into a U-shape and a second clamped spring end part serving as connection terminal, in which the one and the other legs of the U join the first and second spring end parts respectively, said first spring part being disposed substantially perpendicular to the intermediate spring part, and said intermediate part being substantially perpendicular to the infeed plane of the holder; that a stop element is located at the point where the first spring end part and the intermediate spring part join, said stop element extending from the plane of the first spring end part into the infeed plane of the holder; that in the rest condition, the legs of the intermediate spring part converge slightly to each other in the direction of their ends; that the first spring end part extends slantingly past the shifting plane of the connection strips of the card; that a biasing rod having a substantially rectangular cross-section to be inserted and/or operated from outside is provided, said rod lying parallel to and between the stop elements and the bottom of the holder in the rest condition of the contact springs and when rotated by a fourth part of one revolution, the U-legs and so the first spring end parts are bent from the shifting plane of the connecting strips of the card, so that in the subsequent inserting of the card without contact pressure, said card abuts with its front edge against the stop elements of the contact springs, whereafter the biasing rod is newly rotated by a fourth of one revolution and then the contacting strips contact the contact points of the first end part of the springs.

An embodiment according to the second aspect of the invention is characterized in that one or more first spring end parts are pre-bent to the infeed plane of the card more as to the remaining first spring end parts, so that the contact points thereof make earlier respectively disconnect later the contact with the contacting strips of the card than the contact points of the said remaining end parts when the rod is rotated by a fourth of one revolution for making respectively disconnecting the contact.

A further embodiment is characterized in that the second spring end parts extend in upright position from the other U-leg of the contact springs through the bottom of the connector and project parallel to each other out of the connector at the side facing from the insert side.

Yet a further embodiment of the invention is characterized in that the contact springs are separated from each other by insulating partitions accomodated in the connector.

Another embodiment of the invention is characterized in that the connector is provided with a non-conductive support located between the first spring end parts and the infeed plane of the holder and presenting a support face parallel to the holder infeed plane for supporting the said end parts in the rest position, that the said support has at its free end facing to the intermediate spring parts an inclined race for the first spring parts; and that the tip of said first spring end parts extends under an acute angle as to the support face.

BRIEF DESCRIPTION OF THE DRAWINGS

The invention wil be explained further below with reference to the drawin. In the drawing.

FIGS. *2a, 2b, 2c* and *2d* illustrate various schematic embodiments of a contact spring according to the invention.

FIGS. *3a* and *3b* are, respectively, a plan view and a cross-section of an embodiment illustrating the contact between contact spring and a conductor of a ribbon cable.

Figure 4:
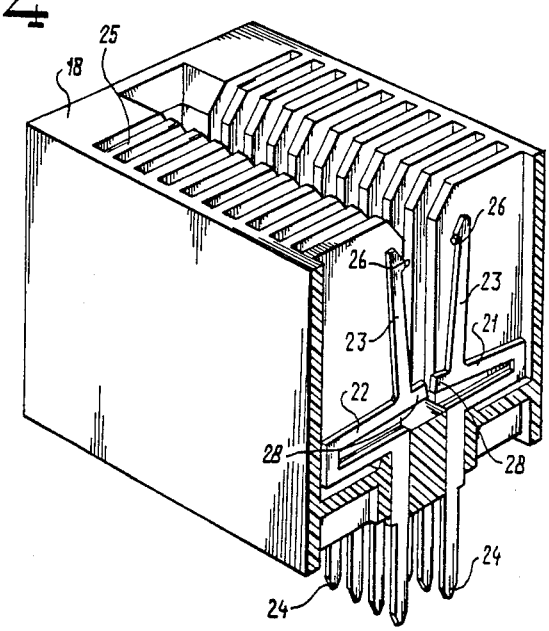

FIG. 4 is a perspective view of an embodiment of the invention for a printed circuit board.

Figure 5:
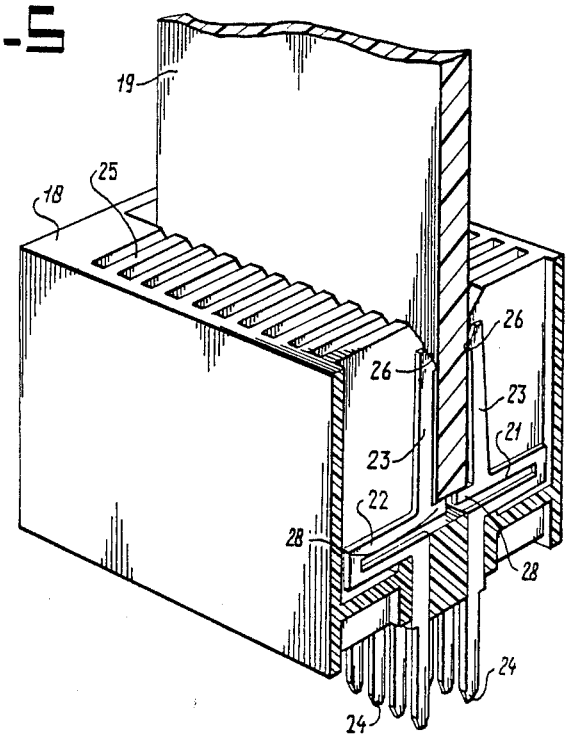
Figure 7:
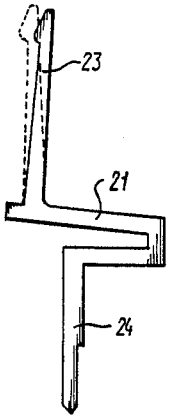
Figure 8A:
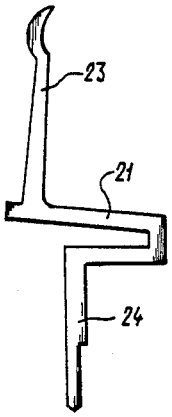
Figure 8B:
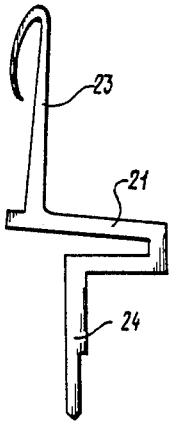
Figure 9:
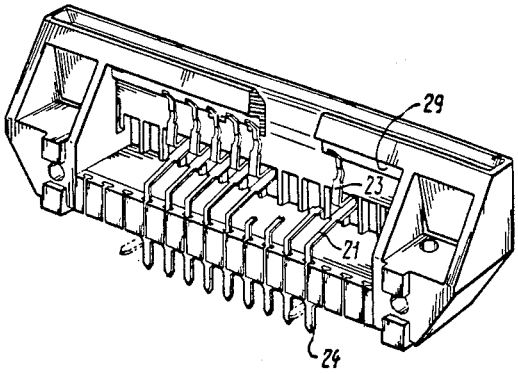

FIG. 5 shows a perspective view of the embodiment of FIG. 4 in which the printed circuit board is inserted;

FIGS. *6a* and *6b* respectively illustrate a cross-section of another embodiment of the invention having a contact spring in unbiased and biased condition, in which the printed circuit board is inserted;

FIG. 7 is a cross-section of one single contact spring being bent additionally;

FIGS. *8a* and *8b* show some modifications of the contact points of a single contact spring;

FIG. 9 illustrates another embodiment of the invention; and

Figure 10:
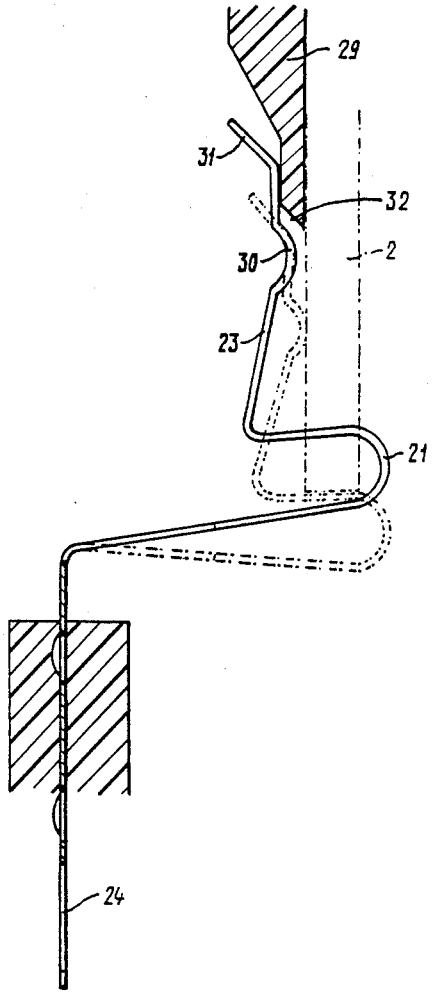

FIG. 10 is a detail of FIG. 9.

DESCRIPTION OF THE PREFERRED EMBODIMENTS

Figure 1:
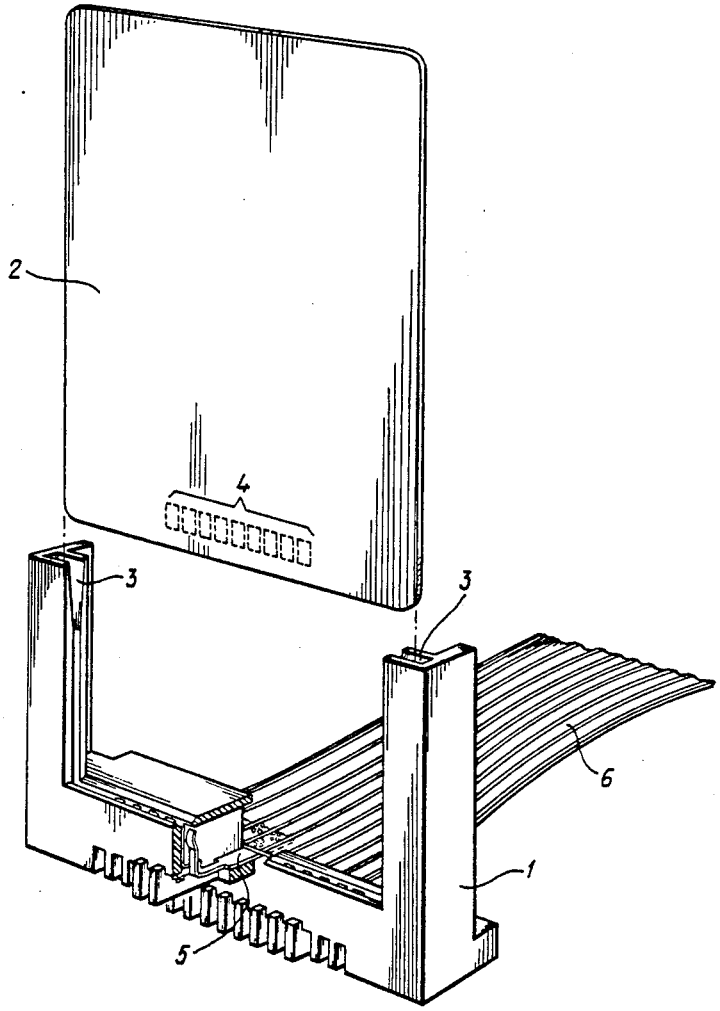
FIG. 1 is a perspective view showing a card reader holder according to the invention.
Figure 2A:
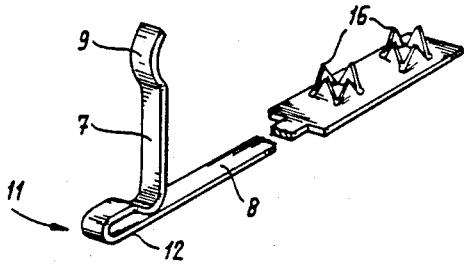
Figure 2B:
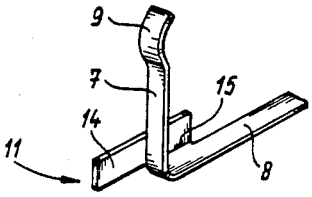
Figure 2C:
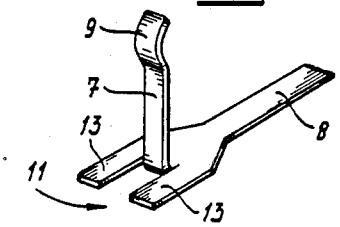
Figure 2D:
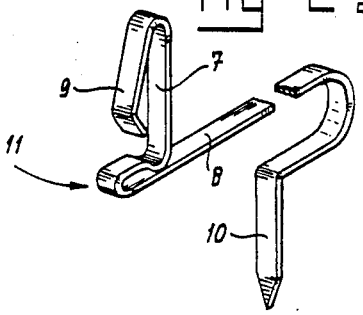
Figure 3A:
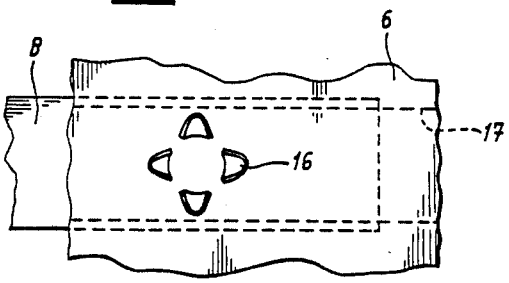
Figure 3B:
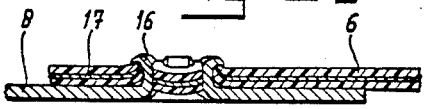

FIG. 1 illustrates a card reader holder 1, above which is a card 2 to be inserted. The card may be an identity card or credit card or the like. On the card 2 are a number of connection strips 4 in the form of edge contacts, which are connected to a memory chip or other similar integrated circuit (not illustrated).

The card reader holder 1 is provided with guide grooves 3 for the card 2 to be inserted. On the underside of the card reader holder 1 there are a number of contact springs 5 which are clamped at one end in the holder. Through the removal of part of the holder, one of the contact springs 5 is clearly visible. The other end of the contact spring 5 is freely movable and will make contact with the edge contact 4 of the inserted card 2. The clamped end of the contact spring 4 is connected to a conductor of the ribbon cable 6, which in turn is connected to the reader device (not shown).

FIGS. *2a* to *2d* show different embodiments of the contact spring 5. The contact springs consist of two parts 7 and 8 which are at right angles to each other. The first contact spring part 7 has a contact face 9 which comes to rest against an edge contact 4 of an inserted card 2 and makes contact with it. The second contact spring part 8 of the embodiments shown in FIGS. *2a, 2b* and *2c* is clamped in the holder. In the embodiment of FIG. *2d*, the contact spring can be clamped by means of a soldering connection pin 10. The contact springs of FIGS. *2a* to *2d* all have a stop element 11, which an inserted card comes up against. The stop element 11 in FIG. *2a* is formed by an extension piece 12 of the second contact spring part 8, which is bent back through 180 degrees and, after a bend of virtually 90 degrees, merges into the first contact spring part 7.

In the contact spring of FIG. *2c*, use is made of two extension pieces 13 of contact spring part 8. Extension pieces 13 run through on either side of the contact spring part 7. These extension pieces 13 serve as the stop element 11 for the card 2 to be inserted. Although two extension pieces 13 are shown here, one could do with one extension piece if necessary. Owing to the fact that two extension pieces 13 are used here, tilting of the contact spring part 7 in its plane is avoided.

The contact spring of FIG. *2b* has only one extension piece 14 as a stop element, which is bent along the bending line 15 in the direction of the contact spring part 7. The pressure of the contact face 9 against an edge contact of an inserted card can be adjusted by setting the dimension of the extension piece 14 in the direction of the contact spring part 7, or by setting the angle of the extension piece 14 relative to the contact spring part 8.

Such adjustment takes place in the embodiment according to FIG. *2a* by pinching in the stop element 11 or causing it to expand. Adjustment is also possible by bending the extension pieces 13 of the contact spring of FIG. *2c*. The embodiment of FIG. *2d* can be adjusted in the same manner as that of FIG. *2a*.

Since the contact springs consist of two parts 7 and 8, at right angles to each other with a stop element 11 near the transition point, when the card 2 is inserted to a particular depth its front edge will come up against the stop element. When the card 2 is inserted further, the clamped part 8 undergoes angular rotation. The other contact spring part 7 thereby undergoes a displacement and is pressed with increasing pressure against the edge contacts 4 of the card 2, without the contact point between edge contact and contact spring shifting in relation to the edge contact or contact spring face 9. The contact pressure will be determined dependent on the vertical displacement of the card and thus of the contact spring parts 7 and 8. On insertion, the card 2 is guided in the guide grooves 3 for this purpose, so that the card undergoes no horizontal displacement. It is clear that during insertion of the card 2 wear is restricted to a minimum through the fact that the abovementioned contact point undergoes no relative displacement when the contact pressure is being built up.

In order to make the whole unit insensitive to dust particles, openings are provided in the bottom of the guide holder, so that no accumulation of dust can occur.

Since the card reader holder is usually fitted on the outside of the card reader device, the contact springs cannot be soldered into a plate with printed wiring, as is usually the case. In this connection, flexible wiring in the form of a ribbon cable 6 is used.

For the contact between a conductor 17 of the ribbon cable 6 and a contact spring, the clamped contact spring part 8 is provided on its end with forced-out points 16 such as shown in FIG. *2a*. It can be seen from FIGS. *3a* and *3b* that this connection is produced by the sharp points 16 being pressed through the film of the ribbon cable and then being flanged back. The connection thereby obtained is produced at four points 16 simultaneously, through these four points partially cut through the signal track. An important part for the signal transmission is still present, particularly in the center of the shrink connection.

As can be seen from the cross-section of FIG. *3a*, the displacement of the partially cut away film has caused the central part to bulge out and, with a force developed in the process, to lie against the inner side of the contact points. Compared with other shrink connections on ribbon cables or flexible films, the film is cut through by rigid material parts and is subsequently deformed in such a way that elastic action of the film on the metal parts is not possible anymore or inadequate.

As explained earlier, the contact spring according to FIG. *2d* is provided with a soldering pin 10. It should also be said that the shape of the contact spring according to FIG. *2d* will be important if the contacts are to be in line with the card 2.

FIG. 4 shows a perspective view of a cut out edge connector, in which a number of parallel spring members are accommodated for engaging contact faces at the insert edge of a printed circuit board. Each contact member consists of two individual opposing contact springs 21 and 22. Each contact spring consists of an intermediate spring part bent in an U-shape, one first spring end part 23 extending in upright position from the one U-leg and a second spring end part 24 implemented as contact pin and extending from the other U-leg. The second spring end parts are clamped in any suitable way in the bottom of the housing 18 of the edge connector. They may project both in upstanding position and parallel to each other from the bottom and through the sidewalls in clamped condition out of the connector.

Figure 6A:
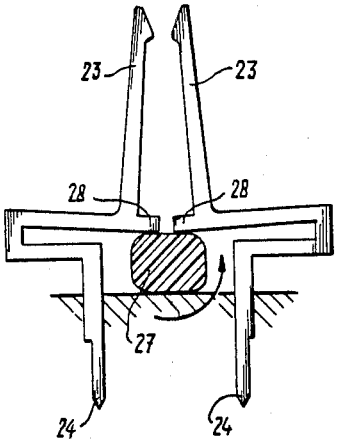
Figure 6B:
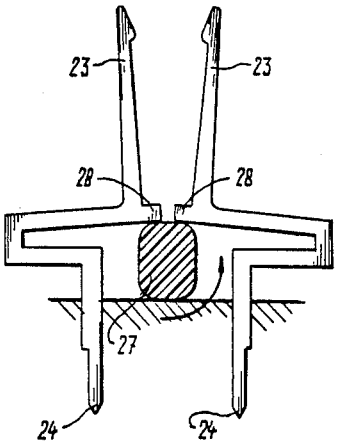

In the embodiments shown in FIGS. 4, 5 and 6 the advantage according to the invention is obtained that, in inserting the printed circuit board a relative movement between contact points of the contact springs and contact faces of the printed circuit board does not occur. Thereby a wearless contacting in realized resulting in a rather unlimited long duration of life of the edge connector.

In the embodiment shown in FIGS. 4 and 5 the contact pressure is built up during inserting. In inserting the printed circuit board 19 its insert edge abuts against a fixed stop element provided by both of the rows of opposing stop lips 28 of the U-shaped intermediate spring parts of the contact springs 21,22. By the subsequent continuous inserting the contact points 26 of the contact springs will engage the opposing contact faces of the printed circuit board and a contact will result. Thereby no or nearly no relative displacements between both spots occur. The printed circuit board is locked now by means of an external locking device and thereby, is kept in its place. By unlocking the printed circuit board this will be pushed away by a common spring force from the individual contact springs, so that the printed circuit board may be removed readily.

In the embodiment according to FIGS. 4 and 5 a small force is required during inserting the printed circuit board, because said printed circuit board should be pressed slightly against the spring force from the individual contact springs.

In the other embodiment, of which FIGS. *6a* and *6b* present a front view of an individual contact spring member, the inserting of the printed circuit board is realized without contact pressure or with zero force. The individual contact springs of each contact spring member are rebent such that the U-legs of the intermediate spring part of each contact spring converge in some extent to each other in unbiased condition and without inserted printed circuit board. A rod 27 to be inserted and/or operated from the outside has been received between e.g. the bottom of the housing of the edge connector and both of the stop lips of the one legs of the intermediate spring parts. By rotating the biasing rod 27 by a fourth of a revolution, as indicated in FIG. *6b* both of the U-legs and consequently also both of the first spring end parts 23 of both of the contact springs are bent from each other. By the subsequent inserting of the insert edge of the printed circuit board it is not required to generate a force and the printed circuit board will ultimately rest against the row of both opposing stop lips. By rotating the biasing rod from the outside by a fourth of a revolution the contact points of both of the first spring end parts 23 will make contact to the contact faces of the printed circuit board without requirement of building up a contact force during inserting. By rotating the biasing rod by a fourth of a revolution for releasing the printed circuit board, said board may be removed from a connector without a further force.

The advantage of said second embodiment is that an additional locking of the printed circuit board is not required anymore. Furthermore, by the absence of the inserting force required otherwise, a higher number of contacts per connector may be employed, e.g. $2\times200$ contacts per connector having a mutual distance of 1.0 mm.

Similarly in this other embodiment one or more contact spring members as indicated in FIG. 7 may be prebent additionally so that the contact points thereof make earlier respectively disconnect later the contact with the contact faces of the printed circuit board (first make, last break) then the contact points of the remaining contact spring members. This feature is of great importance now as the components in the micro-electronic technique are sensitive for static electricity such that this must be discharged in time to earth.

It will be apparent that the shape of the contacts indicated in the drawings may be realized by both punching and folding.

In FIGS. *8a* and *b* some different possible embodiments of the contact points of the individual contact springs are illustrated.

FIG. 9 shows a further embodiment of a connector which may be used in e.g. a card reader holder or printed circuit board holder. In FIG. 10 a detail of said connector is shown in cross-section.

As in the abovementioned embodiments the connector is provided with a number of springs 21, 23, 24 for the connection with contact surfaces on a card of board to be inserted. In the rest position, i.e. in the condition of a not inserted card or board, the free ends 23 of the springs are supported by a support face of a support element 29. When the card is inserted, the intermediate part 21 of each spring is urged downwards and the free ends 23 of the springs slide from the support 29. Then the contacts 30 of the springs engage the corresponding connecting surfaces of the card.

In FIG. 10 the spring 21,23,24 is shown by a solid line in the rest position and by a dashed line in the operation condition.

In the rest position all of the free contact spring ends lie on the support face of the support 9 and may not be damaged by the memo/credit card or printed circuit board during its insertion. When the contact is displaced by inserting the card deeper, the spring ends leave the supporting face of the support 29. As in the operation condition, all of the springs engage with their contact 30 against the contacting surface of the card, they will be displaced with the card by retracting it and by means of the inclined spring tip 31 and the inclined race 32 the springs return into their initial position.

It should be understood that the invention is not limited to the embodiments described above and that modifications and additions are contemplated with the scope of the invention.

We claim:

1. A card reader holder for receiving a card with electronically stored data, said holder comprising an insulating housing with guide means for guiding said card into the holder along an infeed plane, said guide means preventing lateral displacement of said card relative to said infeed plane during insertion;

a plurality of contact springs for contacting corresponding connection strips disposed on said card when the card is inserted into the holder, said contact springs being arranged in a row, one end of each said contact spring being clamped in said insulating housing while the other end of each said contact spring being freely movable and having a contact face which makes contact with its corresponding connection strip when the card is inserted;

each contact spring comprising a first spring part which includes the contact face at the movable end of the contact spring and which extends upward inclined toward said infeed plane of the holder, and a second spring part which includes the clamped end of the contact spring and which provides a connection terminal extending downward from the housing, each said first and second spring parts being joined integrally by an intermediate spring part bent into a U-shape in which the legs of the U are of different lengths, said U being disposed between said first and second spring part and having a shorter upper leg which joins the first spring part and a longer lower leg which joins said second spring part, said U-shaped intermediate spring part extending upwardly inclined into and through the infeed plane of the holder, said shorter upper leg of the U-shape acting as a stop element;

whereby when said card is inserted into the holder, a front end of the card will abut against the upwardly inclined, shorter upper leg of the U of all spring contacts simultaneously, causing the U-shaped intermediate spring part of all said contact springs to be displaced downward until it is approximately perpendicular to the infeed plane of the holder, thereby further inclining the upward extension of said first spring part toward the infeed plane until the contact fact at the movable end of the first spring part is displaced into pressure contact against the corresponding connector strips on the inserted card.

* * * * *